United States Patent [19]

Thompson

[11] Patent Number: 4,574,867

[45] Date of Patent: Mar. 11, 1986

[54] TRAPPED GAS REDUCTION IN DIE CASTINGS

[76] Inventor: William E. Thompson, Rte. 1, Box 89, Middletown, Ind. 47356

[21] Appl. No.: 644,524

[22] Filed: Aug. 27, 1984

[51] Int. Cl.[4] ..... B22D 13/00

[52] U.S. Cl. ..... 164/113; 164/338.1; 164/312

[58] Field of Search ..... 164/67.1, 113, 121, 164/284, 285, 303, 304, 305, 338.1, 66.1, 259, 312

[56] References Cited

U.S. PATENT DOCUMENTS

| | | |
|---|---|---|
| 2,958,104 | 11/1960 | Ohse . |
| 3,349,833 | 10/1967 | Hodler . |
| 3,382,910 | 5/1968 | Radtke . |
| 3,752,213 | 8/1973 | Miki . |
| 3,999,593 | 12/1976 | Kaiser . |

FOREIGN PATENT DOCUMENTS

| | | | |
|---|---|---|---|
| 109239 | 12/1939 | Australia | 164/338.1 |
| 5677058 | 6/1981 | Japan . | |

*Primary Examiner*—Nicholas P. Godici
*Assistant Examiner*—G. M. Reid
*Attorney, Agent, or Firm*—Woodard, Weikart, Emhardt & Naughton

[57] ABSTRACT

A die-casting apparatus for the die-casting of metal into a specific part shape includes a pair of die-cast mold portions which are movable relative to one another and which define a die-mold cavity therebetween. The mold portions are initially separated so as to provide a venting gap and further include a communicating passageway between the die-mold cavity and the shot tube for the apparatus. The shot tube includes a metal inlet port and a cooperating plunger which is suitably designed and arranged to push the molten metal into the die-mold cavity. The shot tube is also fitted with gas inlets which are coupled to a supply of oxygen and a supply of combustion gas whereby an ignited flame may be injected into the shot tube. With the flame injected into the shot tube, the metal introduced and the inlet cover closed, the presence of the ignited flame increases the temperature not only of the air that is present within the shot tube and between the mold portions including the cavity, but the flame also contributes to a temperature elevation of the mold portions and the shot tube. The effect of this added temperature is to expand the volume of air which is trapped within the cavity thus reducing the actual amount of air. Under a somewhat constant pressure condition, the elevation in temperature results in a significant increase in the volume, thus reducing the amount of gas which is able to be trapped within the die-cast part.

5 Claims, 3 Drawing Figures

TRAPPED GAS REDUCTION IN DIE CASTINGS

BACKGROUND OF THE INVENTION

The present invention relates in general to die-casting methods and apparata. More particularly, the present invention relates to a method and apparatus for reducing the amount of trapped gas in die castings, namely aluminum and zinc.

Casting porosity due to shrinkage or gas evolution is a factor of concern with many if not most all casting procedures. One such procedure where trapped gas is of concern is in die-casting work, or as it is sometimes called, pressure die casting.

"In this process molten metal in a viscous condition is forced under high pressure into a steel die, which usually has several cavities connected by channels through which the metal flows almost instantaneously. Because of the speed with which the metal fills the die cavities, the die designer must provide adequate vents to permit the rapid escape of air from the cavities, particularly from pockets and corners; otherwise the casting will be porous because of trapped air. The metal must be viscous rather than fluid or the metal also will squirt through the vents, and yet this very viscosity makes the trapping of air more likely. Consequently, only light sections of the casting are likely to be perfectly sound. Brass die castings having relatively heavy sections (more than one-fourth inch thick for example) will commonly be acceptable if they are used for structural purposes only, but are likely to give trouble if there is any machining to be done in the heavy sections." *Kent's Mechanical Engineers Handbook,* 12th Ed., Wiley Handbook Series, pp. 19–33.

When describing the occurrence of trapped gas in die castings, various terms of art frequently appear and an understanding of these terms is believed helpful to a full understanding of the present invention. The term "gas porosity" refers to the dispersion of fine cavities in the cast metal which result from the fact that some gas is liberated during solidification of the once-molten or viscous metal. Other terms used to describe this type of an effect are microporosity and pinhole porosity. Microporosity is the term that refers to extremely fine porosity caused in castings by shrinkage or gas evolution and is apparent on radiographic films as mottling. The allowable microporosity is covered by ASTM Standard E-192. The term "pinhole" porosity refers to the presence of very small holes scattered through a casting, possibly caused by microshrinkage or gas evolution during solidification. Allowable pinhole porosity is also covered by ASTM Standard E-192.

As indicated by these various terms of art, porosity in castings occurs not only due to shrinkage porosity but also because of trapped gas. The presence of trapped gas results by the atmosphere in the volume of the part cavity being replaced with molten metal. In addition, there is the volume of air that gets pushed in from the shot tube when the cold chamber casting method is used. This volume of air plus the mold-release vapors must be vented out of the cavity if a sound casting is made; however, this has never been done perfectly. There has been a myriad of venting ideas and many attempts to evacuate by reducing the pressure within the part cavity by some means of vacuum pumping, the best of which results in little better than one-half atmosphere reduction. Approaches similar to the evacuation method are also found in certain prior art references. A sampling of those references are listed below, and while none are believed to teach nor anticipate the present invention, they are to some degree instructive as to the types of approaches which have been considered or tried by others.

| Patent No. | Patentee |
|---|---|
| 2,958,104 | Ohse |
| 3,349,833 | Hodler |
| 3,382,910 | Radtke |
| 3,752,213 | Miki |
| 3,999,593 | Kaiser |

Ohse discloses a vacuum die-casting process and apparatus which involves the feeding of molten material into a die cavity which is positioned between relatively movable die members and which is communicating with a substantially horizontally extending feed chamber having a volumetric capacity which is greater than that of the die cavity. The process involves the introduction of a charge of molten material through a feed port into a feed chamber wherein the amount of the charge is such that a free space is left above the charge in the portion of the feed chamber extending from the feed port toward the die cavity. As the molten metal is moved toward the die cavity and with the apparatus sealed, the die cavity and the communicating free space in the feed chamber is subjected to a vacuum in order to remove from the die cavity and the communicating space any air or gases.

Hodler discloses a pressure-molding venting method for use with die-casting work wherein an air vent in the die-casting machine is provided with a spring-loaded normally closed valve which may be held open by a trapped body of pressure fluid from the die-closing mechanism. The fluid is released by a pilot valve which responds to the sudden pressure rise in the hydraulic fluid injection mechanism which occurs when the injected liquid metal enters the vent from the wider die cavity.

Radtke discloses a method of pressure die-casting which is intended to be applicable to die-casting machines in which relatively movable die members are closed to form a die cavity which is a negative impression of the article to be produced. The die cavity communicates with a reservoir of molten metal and during the operation of the machine, the die members are brought together in order to form the die cavity and the molten metal is introduced. While this is generally the description of any die-casting machine and its method of use, this particular invention focuses on the problem of porosity in die casting and a possible solution to that problem. The approach to that solution in this particular reference is to purge air from within the die cavity by flushing the cavity with a reactive gas and then sebsequently inject molten metal into the reactive gas-filled cavity whereby the reactive gas combines with the molten metal thus reducing the tendency for voids to form in the casting which is produced.

Miki discloses a die-casting method and apparatus which employs an oxygen flush in order to reduce trapped gas porosity in the resulting die casting. The approach followed is to attempt to concentrate shrinkage pores in the unimportant regions of the product by positively retarding the solidification of the cast metal in those regions so that the strength defects may be reduced in essential or critical regions of the resultant product.

Kaiser discloses a method and apparatus for pore-free die casting wherein a gas which is designed to react with the cast material flushes air from the various openings and spaces within the mechanism as well as from the die cavity. The reactive gas replaces the air in these locations so that the air is not forced into the die cavity by the material when it fills the die cavity. Due to the fact that air in the die cavity would form pores in the cast material, the intent by this particular reference is to flush or remove the air by the introduction of the reactive gas.

None of the foregoing concepts, methods or devices dsiclosed by the listed references offer any noticeable improvement to the general approach of vacuum pumping which, as mentioned, results in little better than a one-half atmosphere reduction. However, by the present invention, a means of achieving a much greater efficiency is provided. Calculations relating to the method and apparatus of the present invention have indicated the ability to achieve approximately 80–90% efficiency in reducing the amount of gas weight resident in the shot tube and part cavity.

SUMMARY OF THE INVENTION

A die-casting apparatus for the die casting of metal into a specific part shape according to a typical embodiment of the present invention includes a pair of mold portions, one movable relative to the other, wherein the pair defines a die-mold cavity, a shot tube having a passageway disposed therein which is in flow communication with the die-mold cavity and flame-injection means for elevating the temperature of any gas disposed within the die-mold cavity thereby reducing the amount of such gas able to be trapped in the die-cast part.

One object of the present invention is to provide an improved die-casting apparatus.

Related objects and advantages of the present invention will be apparent from the following description.

DESCRIPTION OF THE PREFERRED EMBODIMENT

Figure 1:
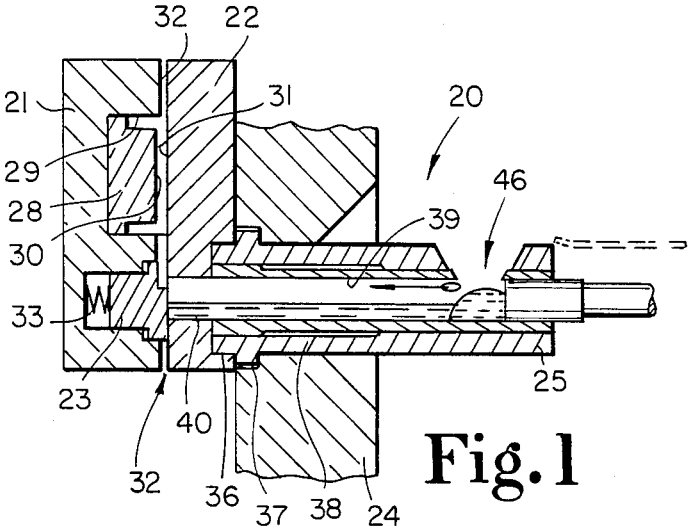
FIG. 1 is a diagrammatic, partial side elevation view in full section of a die-casting apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated in diagrammatic form an apparatus 20 for the die casting of metal objects which includes as the primary components a cavity portion 21, a die-mold closing portion 22, a spring-biased end cover 23, platen 24 and shot tube 25. Positioned within cavity portion 21 is die member 28 which is secured within recess 29 and whose exposed surface 30 in combination with the facing abutment surface 31 of the closing portion 22 and the exposed portions of recess 29 determines the configuration of the part or parts to be cast.

Figure 3:
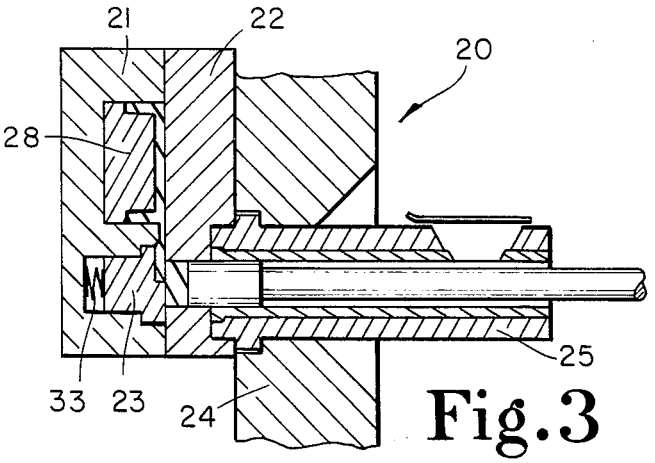
FIG. 3 is a diagrammatic, partial side elevation view of the FIG. 1 casting apparatus in a mold-closed condition.

As illustrated in FIG. 1, the two portions are initially spaced apart by a relatively narrow clearance region 32 which functions as a venting gap. End cover 23 extends into region 32 and with spring 33 in an unbiased state cover 23 is held in position in abutment against surface 31. As closing portion 22 is pushed into a closed condition against cavity portion 21, as the molten or viscous metal is introduced into the mold cavity for the desired part, the spring is compressed allowing the end cover to move in response and the venting gap is eliminated. FIG. 3 is an illustration of the two mold portions in a closed condition, also illustrating the compression (shortened overall length) of spring 33.

Shot tube 25 is configured with a lead portion 36 which fits within closing portion 22, a flange 37 which fits within platen 24 and abuts against closing portion 22, a main portion 38 and a centrally disposed passageway 39. As illustrated, closing portion 22 includes a flow passageway 40 which is partially closed at one end by end cover 23. The upper section of passageway 40 which is left open is in flow communication with the venting gap and the mold cavity for the desired part. Passageway 39 is concentric with and in direct flow communication with passageway 40 thereby enabling the delivery of molten or viscous metal which is within the shot tube into the mold cavity.

Figure 2:
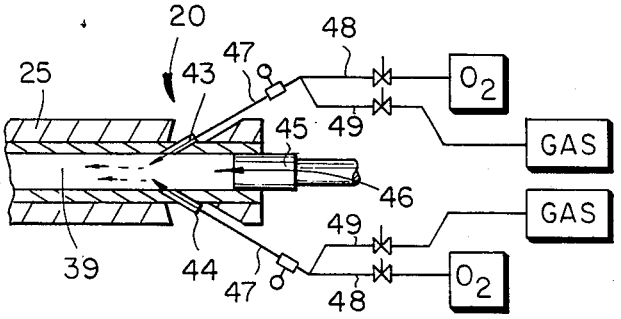
FIG. 2 is a diagrammatic, top plan view of the FIG. 1 casting apparatus including the gas lines for flame injection.

Referring to FIG. 2, the shot tube is further fitted with gas inlets 43 and 44 which are disposed on opposite sides of the shot tube which also includes a plunger 45 which is designed and arranged for a snug, yet sliding fit within central passageway 39 of the shot tube. A molten metal inlet 46 is porvided in the top surface of the shot tube for the introduction of the metal of the desired part to be die cast. As will be explained hereinafter, this inlet also includes a cover operable relative to the shot tube to close this inlet opening so as to seal closed this point of access. As a result of this cover, and its actuation to close the inlet, any gas or atmosphere trapped within the shot tube or introduced with the molten metal is closed off from the atmosphere at the location of the inlet to the shot tube and forced to exit in the direction of the part cavity and outward to the atmosphere through the venting gap which is disposed between the two mold portions. Gas inlets 43 and 44 are each fitted with a corresponding flow conduit line 47 and upstream each conduit line splits into two branches 48 and 49. One branch carries oxygen and the other a suitable pilot gas. These conduits and inlets 43 and 44 bring a preignited pilot gas and oxygen flame into communication with the cold chamber shot tube and then the cover to the metal inlet is closed in order to exclude the normal outside atmosphere. The flow of the gas and oxygen mixture (flame) continues and increases in a volumetric sense to a preset level which is reached at the time corresponding to the time at which there is a prefill of molten metal, such as aluminum. At this point in the operating cycle of the disclosed apparatus 20, the two mold portions are positioned as illustrated in FIG. 1 and are disposed relative to one another to within a specified gap in order to allow peripheral leakage of the products of combustion to purge out all of the original air from the part cavity. The venting gap can be either a purposeful die-mold portion spacing before complete closure as illustrated, or some other means of vent-valving. With the gas still flowing, the two mold portions 21 and 22 are clamped closed and the "shot" of molten or viscous metal which has been previously loaded into the shot tube 25 is introduced into the mold cavity for the part by the action of plunger 45 being pushed toward end cover 23. The gas and thus the flame are substantially shut off with completion of the shot. The mold in a closed condition, at the completion of the shot, is illustrated in FIG. 3.

The disclosed apparatus and the steps of the described method involves, in its most simple form, the act of replacing the original atmosphere of the shot tube and die cavity which is otherwise at room temperature with a super-heated gas. The super-heated gas is generated from the products of combustion of the gas and oxygen flame previously described. This begins as a flame (pilot) of relatively low intensity at the point in time that the metal injection or pouring occurs up to a comparatively large flame source which flushes and fills the mold portions, their clearance space or vent gap and the mold cavity with the super-heated gas thereby elevating the temperature of those areas.

In this approach, the pressure remains relatively constant leaving only the volume and temperature relationship to deal with. Depending on the temperature increase, there is a voume change and reduction in the amount of gas which can be trapped. Using a mid-range temperature where the absolute final temperature is roughly ten times the absolute initial temperature, the result is a condition where only one-tenth as much gas is able to occupy the cavity space. The effect is a reduction in the amount of trapped gas in the die-cast parts which are produced. By closing the molten metal inlet after introduction of the metal while the flame continues, the only "escape" path is through the two passageways 39 and 40 and from there on into the venting gap. The flushing action is effective to push out the existing gas which is at room temperature and fill this space with a super-heated gas which is at a temperature approximately ten times that of the room temperature gas. Since the venting gap is initially open and exposed to the atmosphere, the pressure within does in fact remain relatively constant as the filling occurs. Some of the various relationships for the foregoing result are included hereinafter.

By Charles' Law, the relationship of volume and temperature of gas at a constant pressure is given by the expression:

$$V_1/T_1 = V_2/T_2 \quad \text{(Eq. 1)}$$

and thus:

$$V_2 = V_1 T_2/T_1 \quad \text{(Eq. 2)}$$

Gas combustion temperatures and oxygen will vary depending on the selected gas, from a relatively low level which is represented by propane 4579° F. to a higher level of 5589° F. for acetylene. The use of Equation 2 for finding the expanded volume of one unit of gas requires that we first convert degrees Fahrenheit to degrees Rankine. Using Equation 2 for propane and using 70° F. as room temperature, we have the following expression:

$$V2 = \frac{1 \times (4579 + 459)}{(70 + 459)} \quad \text{(Eq. 3)}$$

and thus:

$$V_2 = 5038 \div 529 = 9.5 \quad \text{(Eq. 4)}$$

The 9.5 times increase in volume means that there is only 1/9.5 or approximately 10.5% as much gas occupying the cavity space at the elevated temperature as there was at room temperature. For acetylene the volume increase ratio is 11.4 which results in only 8.8% as much gas occupying the cavity space.

The logic of this particular approach is perceived as being a significantly more effective means of controlling the amount of trapped gas in die-casting process than what has previously been done by means of vacuum processes or the use of a reactive gas for flushing. The method and apparatus of the present invention is especially beneficial where there are complex casting configurations due to the greater difficulty of providing any alternative method of venting for these complex shapes. one of the additional concerns with die-casting work and thus part of the need for the present invention is that where gas is trapped under high pressure, it will later cause blisters duing post-heating or surface finishing. Not only does the present invention effectively reduce this concern as it reduces the amount of trapped gas in the parts, but a beneficial side effect of the present invention is believed to result from the momentary heating of the die surfaces at the instant just prior to the shot of molten metal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of using a die-casting apparatus for reducing the amount of trapped gas in the die-cast part, the apparatus having a pair of mold portions, a die cavity and a shot tube, said method including the steps of:

preparing the die-casting apparatus for receiving a shot of metal for the die-cast part;

placing the shot of metal within the shot tube by way of a shot tube inlet;

injecting a gas flame into the shot tube; and closing the shot tube inlet.

2. The method of claim 1 which further includes, following the step of closing the shot tube inlet, the steps of:

continuing the injection of the gas flame;

activating a shot tube plunger for pushing the shot of metal into the die cavity; and terminating the gas flame.

3. The method of claim 2 wherein said terminating step occurs simultaneously with the completion of the activating step.

4. A method of using a die-casting apparatus for reducing the amount of trapped gas in the die-cast part, the apparatus having a pair of mold portions, a die cavity and a shot tube, said method including the steps of:

preparing the die-casting apparatus for receiving a shot of metal for the die-cast part;

placing the shot of metal within the shot tube by way of a shot tube inlet;

injecting a gas flame into the shot tube; and activating a shot tube plunger for pushing the shot of metal into the die cavity.

5. The method of claim 4 which further includes the step of closing the shot tube inlet preceding the activating step.

* * * * *